US012560108B2

(12) United States Patent
Pesce et al.

(10) Patent No.: US 12,560,108 B2
(45) Date of Patent: Feb. 24, 2026

(54) INTERNAL COMBUSTION ENGINE WITH OPTIMIZED INTAKE SYSTEM

(71) Applicant: Dumarey Automotive Italia S.p.A., Turin (IT)

(72) Inventors: Francesco Concetto Pesce, Turin (IT); Alberto Lorenzo Vassallo, Turin (IT); Luca Buzzi, Turin (IT)

(73) Assignee: Dumarey Automotive Italia S.p.A., Turin (IT)

( * ) Notice: Subject to any disclaimer, the term of this patent is extended or adjusted under 35 U.S.C. 154(b) by 0 days.

(21) Appl. No.: 18/877,825

(22) PCT Filed: Jul. 10, 2023

(86) PCT No.: PCT/IB2023/057057
§ 371 (c)(1),
(2) Date: Dec. 20, 2024

(87) PCT Pub. No.: WO2024/013634
PCT Pub. Date: Jan. 18, 2024

(65) Prior Publication Data

US 2025/0369374 A1 Dec. 4, 2025

(30) Foreign Application Priority Data

Jul. 14, 2022 (IT) ..... 102022000014827

(51) Int. Cl.
*F01L 13/00* (2006.01)
*F01L 1/053* (2006.01)
*F01L 1/08* (2006.01)
*F01L 1/14* (2006.01)
*F01L 9/14* (2021.01)

(52) U.S. Cl.
CPC ..... *F01L 1/053* (2013.01); *F01L 1/08* (2013.01); *F01L 1/143* (2013.01); *F01L 9/14* (2021.01); *F01L 13/0031* (2013.01); *F01L 2305/00* (2020.05)

(58) Field of Classification Search
CPC ..... F01L 2001/054; F01L 1/14; F01L 1/143; F01L 1/08; F01L 13/0031
See application file for complete search history.

(56) References Cited

U.S. PATENT DOCUMENTS 10,428,746 B2 * 10/2019 Hedvik ..... F01L 1/146

* cited by examiner

*Primary Examiner* — Ngoc T Nguyen
(74) *Attorney, Agent, or Firm* — R. Ruschena Patent Agent, LLC

(57) ABSTRACT

The present invention relates to an internal combustion engine provided with an optimized intake system. The engine derives from a traditional diesel cycle engine but is modified and optimized in its intake system to achieve performance superior to that of traditional diesel engines. According to the invention, some main characteristics of the timing system are modified to obtain, when required, a specific behavior of the intake valve lift curve. By operating in this way, it is possible to carry out an internal recirculation of the burnt gases, a reforming of the fuel (for example, from ammonia to hydrogen), a thermodynamic cycle similar to a Miller cycle.

10 Claims, 5 Drawing Sheets

INTERNAL COMBUSTION ENGINE WITH OPTIMIZED INTAKE SYSTEM

1. FIELD OF THE INVENTION

The present invention relates to an internal combustion engine provided with an optimized intake system.

The engine derives from a traditional diesel cycle engine but is modified and optimized in its intake system to achieve performance superior to that of traditional diesel engines. According to the invention, some main characteristics of the timing system are modified to obtain, when required, a specific behavior of the intake valve lift curve.

2. BRIEF DESCRIPTION OF THE PRIOR ART

Motor vehicles typically operate by using an internal combustion engine to convert the energy of a fuel, such as gasoline or diesel, into mechanical energy to drive the motor vehicle and thereby provide motion to the vehicle's wheels. Unfortunately, fossil fuels are expensive and contribute to environmental pollution. Due to these drawbacks, attention has been paid to the problems of reducing fuel consumption and pollutants emitted by automobiles and other highway vehicles.

There is therefore the need to define an innovative internal combustion engine which is free from or at least minimizes the above-mentioned drawbacks, especially in terms of polluting emissions.

SUMMARY OF THE INVENTION

In order to substantially solve the technical problems highlighted above, an object of the present invention is to define an internal combustion engine provided with an optimized intake system.

The engine derives from a traditional diesel cycle engine but is modified and optimized particularly in its air-fuel mixture intake system. According to the invention, some main characteristics of the timing system are modified to obtain, when required, a specific behavior of the intake valve lift curve.

By operating in this way, it is possible to carry out an internal recirculation of the burnt gases (internal EGR), a reforming of the fuel (for example, from ammonia to hydrogen), a thermodynamic cycle similar to a Miller cycle.

The invention is applicable to various types of engines with different bores, cylinder head arrangement, rotation speeds and type of mission. Marine and stationary diesel engines in particular are suitable to this optimization.

Therefore, according to the present invention there is provided an internal combustion engine with optimized intake system, the engine having the characteristics set forth in the independent claim, annexed to the present description.

Further embodiments of the invention, preferred and/or particularly advantageous, are described according to the characteristics set forth in the attached dependent claims.

BRIEF DESCRIPTION OF THE DRAWINGS

The invention will now be described with reference to the attached drawings, which illustrate some non-limiting embodiments, in which.

DETAILED DESCRIPTION OF THE INVENTION

Figure 1:
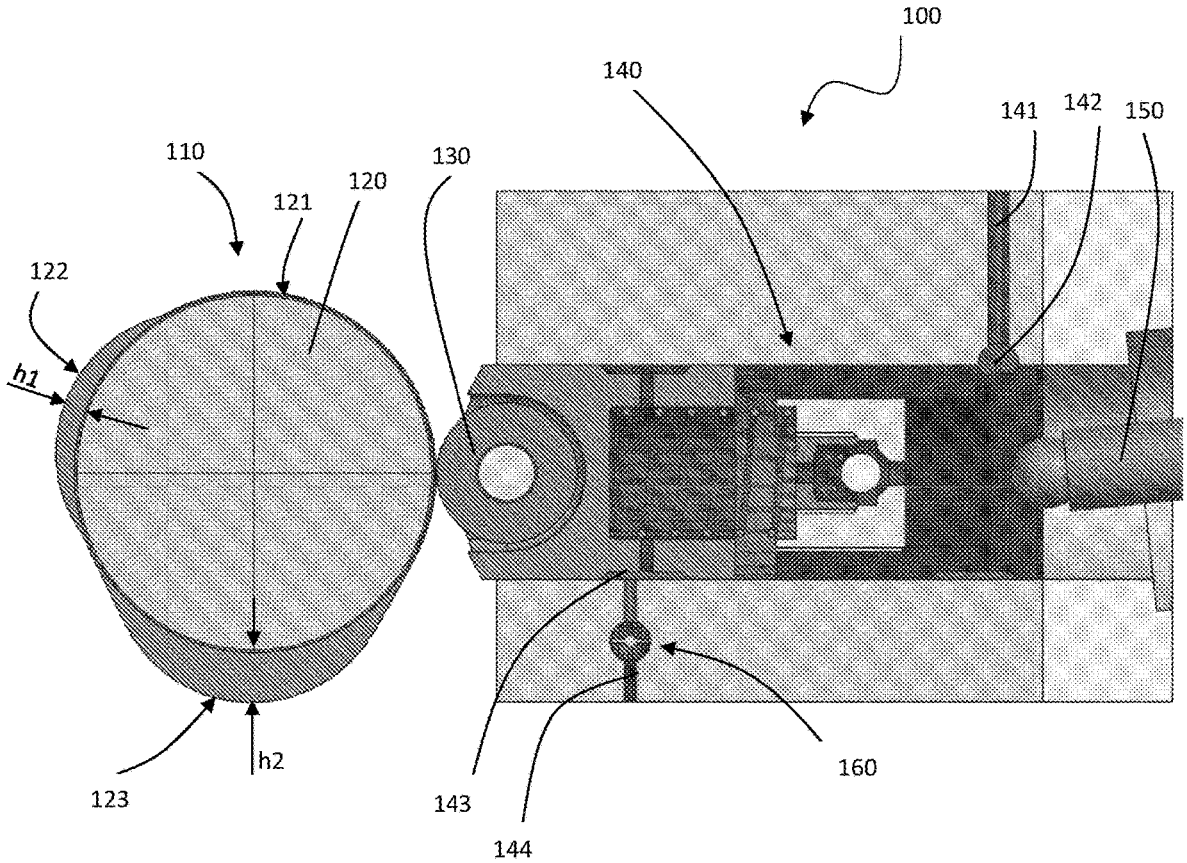
FIG. 1 is a schematic section of a timing system with a control valve for operating the intake system of the internal combustion engine according to an embodiment of the present invention.

By way of a purely non-limiting example, the present invention will now be described with reference to the aforementioned figures.

The invention is an internal combustion engine which derives from a traditional direct injection diesel cycle engine but is modified and optimized in its timing system and consequently in the performances of its intake system.

The internal combustion engine is a volumetric motive machine in which a cycle equivalent to the well-known Diesel cycle takes place. In fact, in the Diesel cycle, a first reactant, essentially made up of air, is introduced into a cylinder in which a piston moves. It is compressed thanks to a closure of the cylinder in which the reactant is contained (a closure that can take place, for example, by closing valves).

A volumetric compression ratio is identified as the ratio between the initial volume of the first reactant charge and the final volume at the end of the reduction process of the volume contained in the envelope, R=Vi/Vf. In the absence of the limit imposed by the detonation phenomenon in a Diesel type scheme, the compression ratio can typically be raised in the range of 10-20. A higher compression ratio can correspond to a higher energy efficiency. The compression takes place in a short time so that the heat exchange with the casing is a small fraction of the energy required for the compression. In this way a compression close to an adiabatic transformation is achieved, whereby the temperature at the end of the compression is much higher than the initial one. Around the end of compression point (typically with a certain advance compared to the point itself), a second reactant, hydrocarbon or other fuel, is introduced through a duct called an injector, with a much higher pressure than that of the first reactant contained in the casing, which rapidly mixes with the first reactant. Thanks to the high temperature reached by the first reactant due to the compression, a reaction starts between the two reactants, which leads to the formation of third compounds, with development of the reaction energy. In many machines, the injection of the second reactant takes place in a time-modulated manner, to obtain a good completeness of the reaction. Furthermore, it is possible that more reagents are introduced, for example to overcome the difficulty of triggering the reaction of the reagents (technique adopted, for example, in "dual fuel" engines, in which a fraction of reagent, typically fuel gas, is added to the air introduced into the casing) and the start of the oxidation reaction is ensured by the injection, at the end of compression, of a small quantity of liquid fuel with easy ignition characteristics.

This is followed by the expansion inside the casing, with collection of the expansion energy of the high temperature gas resulting from the reaction, and the expulsion of the reaction products, through suitable valves or openings.

What has been described, in the event that the first reactant is air and at least one second reactant is a fuel or in any case a substance which can implement an oxidation reaction by the oxygen present in the air, constitutes the known functioning of a Diesel cycle machine.

According to the invention, the internal combustion engine reproduces what is described and known to those skilled in the art (and is equipped with standard components except for what will be said below), but has various innovative characteristics.

First of all, the internal combustion engine according to the present invention is fed with hydrogen or fed with ammonia (or other liquid fuel which can be considered a hydrogen "carrier") and which, as will be explained below, has the function of fuel but also of reactant in the reforming process for the formation of hydrogen.

With reference to FIG. 1, the internal combustion engine also has a particular timing system 100. The timing system can indifferently operate the intake system (as well as the exhaust system) of a single-cylinder engine or of a multi-cylinder engine. The figure shows the camshaft 110 for controlling the intake valves, with a cam 120 provided with a circular base profile 121, with a first cam profile 122, and with a second cam profile 123 of greater height than that of the first cam profile 122. For example, the height value h1 of the first cam profile 122 could be equal to 0.8 mm while the height value h2 of the second cam profile 123 could be equal to 1.0 mm. The timing system 100 comprises a hydraulic tappet 140 and can also be provided with a roller 130 and a pressure rod 150. The hydraulic tappet 140 comprises a supply duct 141 of pressurized oil coming from the lubrication circuit of the internal combustion engine in communication with an oil inlet port 142 inside the hydraulic tappet 140, an oil drain port 143 and an oil exhaust duct 144 in communication with the oil drain port 143. The oil drain port 143 has a controlled height equal to the difference of the heights h2−h1 of the corresponding two cam profiles 123, 122. By way of example, therefore, the controlled value of the height of the oil drain port 143 could be equal to 0.2 mm, i.e., the difference between 1.00 mm and 0.8 mm.

The hydraulic tappet 140 per se is of a known type and its operation is known. However, it differs from other hydraulic tappets in that its operation is controlled by a control valve 160 located in the oil exhaust duct 144 and selectively in communication with the drain port 143. This hydraulic tappet oil control valve 160 is of the ON/OFF type. Advantageously it is a normally open valve. Preferably, it is a solenoid valve.

The presence of this control valve 160, as will be better explained hereinafter, allows to obtain a different dynamic of the lift curve of the intake valve (valve of a known type and therefore not illustrated).

What has been described up to now relates to a timing system of the pushrod and rocker arm type, with a camshaft arranged in the base of the internal combustion engine. The characteristics of the timing system illustrated above, however, are also applicable to different layouts of the timing system, for example those that provide for the camshaft to be housed in the cylinder head (so-called "overhead" timing system).

Figure 2:
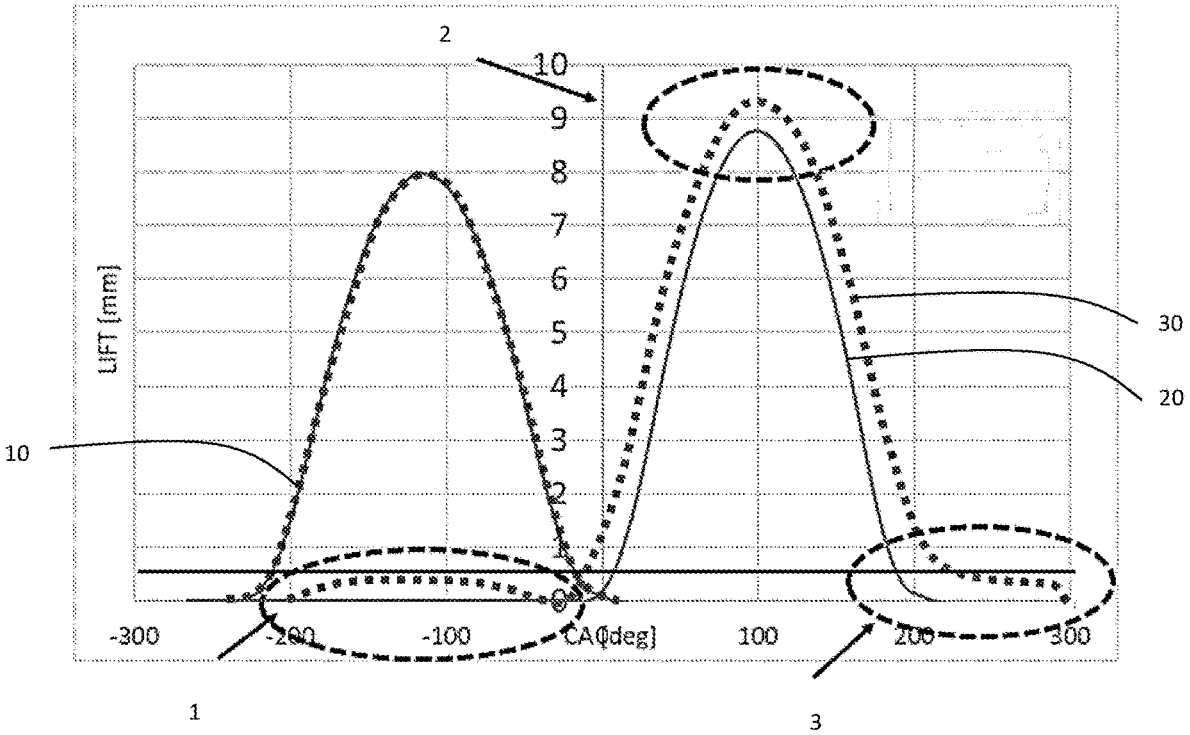
FIG. 2 is a diagram of the lift of the intake and exhaust valves.

FIG. 2 shows the diagram of the lifts of the intake and exhaust valves, according to the present invention. The lift curve 10 of the exhaust valve follows an almost typical trend of a Diesel engine: its opening begins a little before the bottom dead center (BDC, crank angle equal to −180° in FIG. 2) and ends a little beyond the top dead center (TDC, crank angle equal to 0° in the diagram of FIG. 2). Conversely, the intake valve lift curve changes depending on whether the control valve 160 is open (ON) or closed (OFF). In the first case (control valve 160 open), the lift curve 20 of the intake valve also follows the typical trend of a Diesel engine: its opening begins a little before the TDC (crank angle equal to) 0° and ends a little beyond the BDC (crank angle equal to) 180°. Therefore, the crossover phase between the two valves (intake and exhaust) is almost negligible. The lift curve 20, now described, can advantageously be used in the full power operating mode of the internal combustion engine.

In the second case (control valve 160 closed), the lift curve 30 of the intake valve is characterized as follows:

- opening a little before the BDC (crank angle equal to)−180°, then during the exhaust phase, with a small but not negligible lift until reaching the TDC (phase 1). This long crossing phase between the exhaust valve and the intake valve allows a non-negligible recirculation of the exhaust gases. Therefore, an internal EGR is created and, as better explained below, a reforming process of the ammonia into hydrogen;
- an opening phase with achievement of a maximum lift value (phase 2) higher than the maximum value of the previous lift (lift curve 20) between the TDC and slightly beyond the BDC (crank angle equal to) 180°;
- a final phase (phase 3) between the PMI and a crank angle value of approx. 300°, i.e., a value which corresponds to about ⅔ of the theoretical compression phase, in which the intake valve tends to close but having started from a higher maximum lift value, it still maintains a small but not negligible lift value which influences the compression phase, reproducing a so-called "Miller" cycle, to which and to the produced effects we will come back later on. The lift curve 30, now described, can advantageously be used in the operating modes at partial loads of the internal combustion engine.

The different dynamics of the intake valve lift curve is determined, as mentioned, by the control valve 160 in combination with the position of the cam 120. The explanation of this different dynamics will now be made with reference to FIGS. 3*a*-3*c* and 4*a*-4*c*.

These figures illustrate different operating configurations of the timing system, first with the control valve 160 open (ON, FIG. 3*a*-3*c*) and subsequently with the control valve 160 closed (OFF, FIG. 4*a*-4*c*), in combination with the corresponding lift diagrams of the intake and exhaust valves of the internal combustion engine.

Figure 3A:
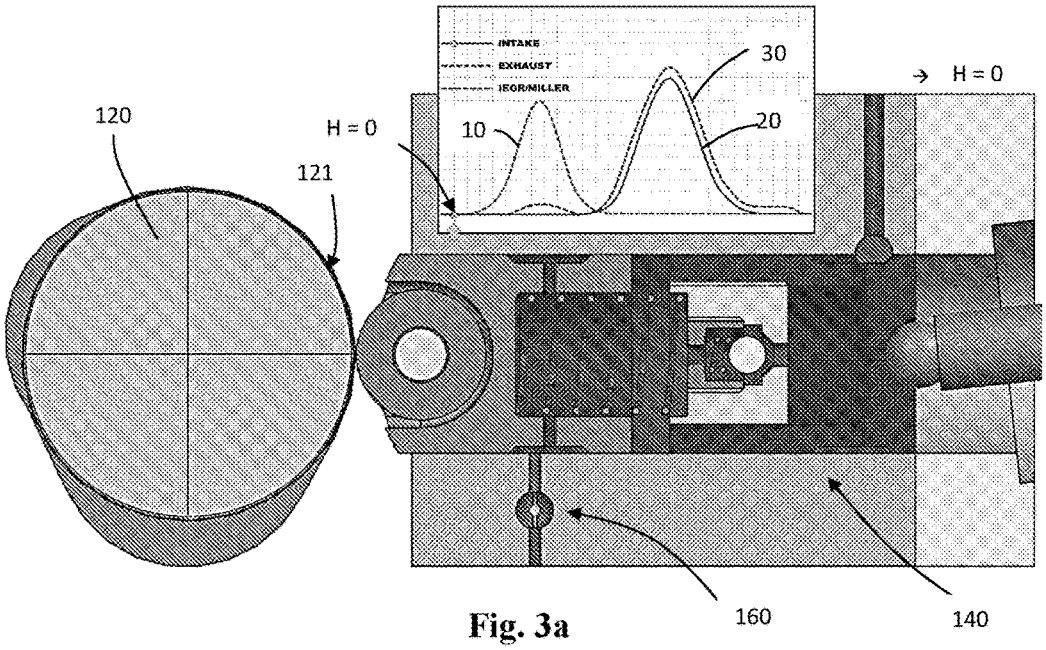
FIGS. 3*a*-3*c* show the timing system of FIG. 1 in three different operating configurations, with the control valve open.

In FIG. 3*a*, the cam 120 cooperates with the remaining components of the timing system by means of its circular base profile 121. The hydraulic tappet 140 does not undergo displacements and consequently the lift H of the intake valve (illustrated both in the diagram of the timing system and in the lift diagram of the intake and exhaust valves) is equal to 0.

Figure 3B:
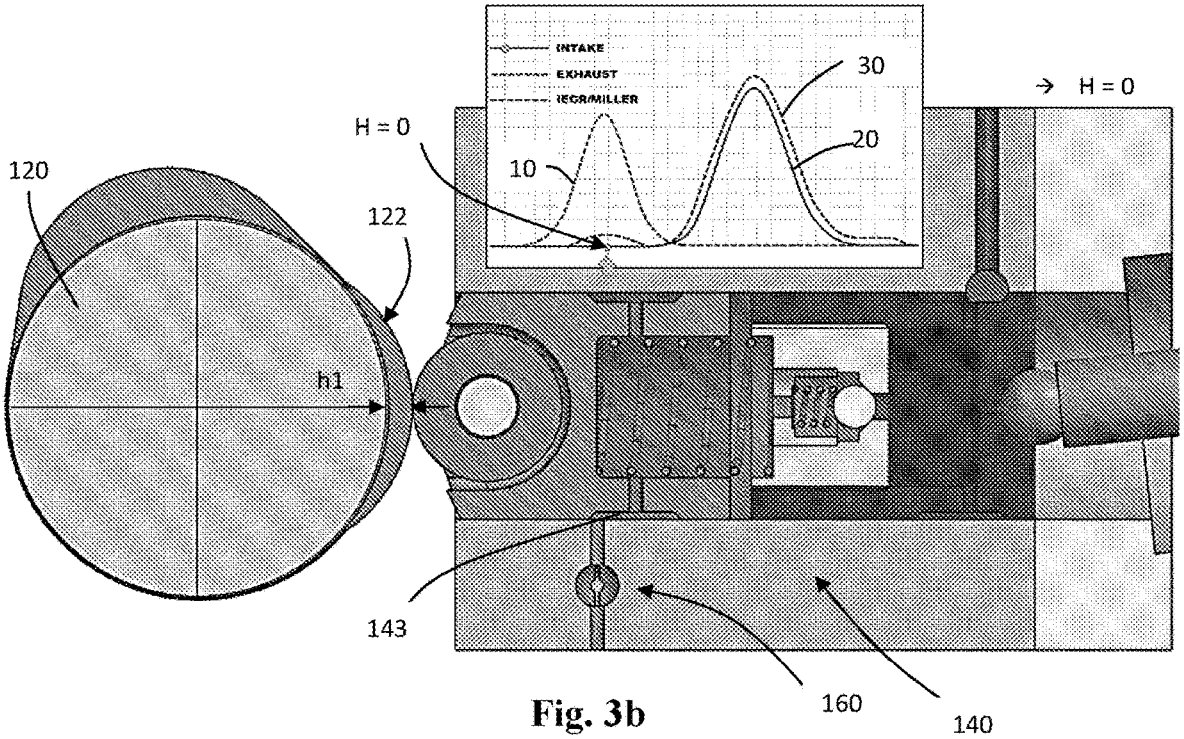

In FIG. 3*b*, the cam 120 cooperates with the remaining components of the timing system by means of its first cam profile 122. Due to the fact that the control valve 160 is open and in communication with the drain port 143, the hydraulic tappet 140 is not pressurized and, therefore, continues not to undergo displacements and, consequently, the lift H of the intake valve is always equal to 0.

Figure 3C:
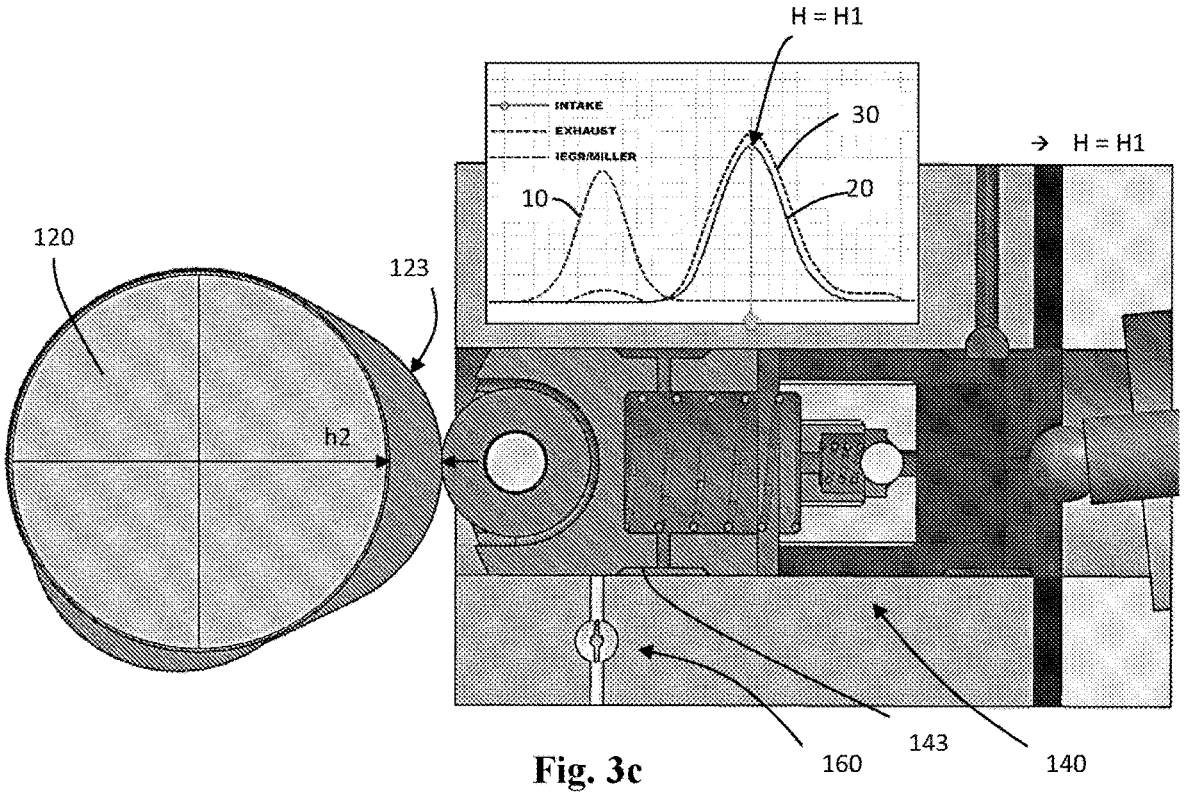

Finally, in FIG. 3*c*, the cam 120 cooperates with the remaining components of the timing system by means of its second cam profile 123 (of greater height than that of the first cam profile 122). Even if the control valve 160 is always open, there is no longer communication between it and the drain port 143 (which precisely has a controlled height). Therefore, the hydraulic tappet 140 is pressurized by the oil and can therefore transfer motion to the intake valve which will open reaching in the configuration of FIG. 3*c* a lift H equal to a first maximum value H1.

Ultimately, with the control valve 160 open, the timing system 100 creates the lift curve 20 of the intake valve, in the typical pattern of a traditional diesel engine.

Figure 4A:
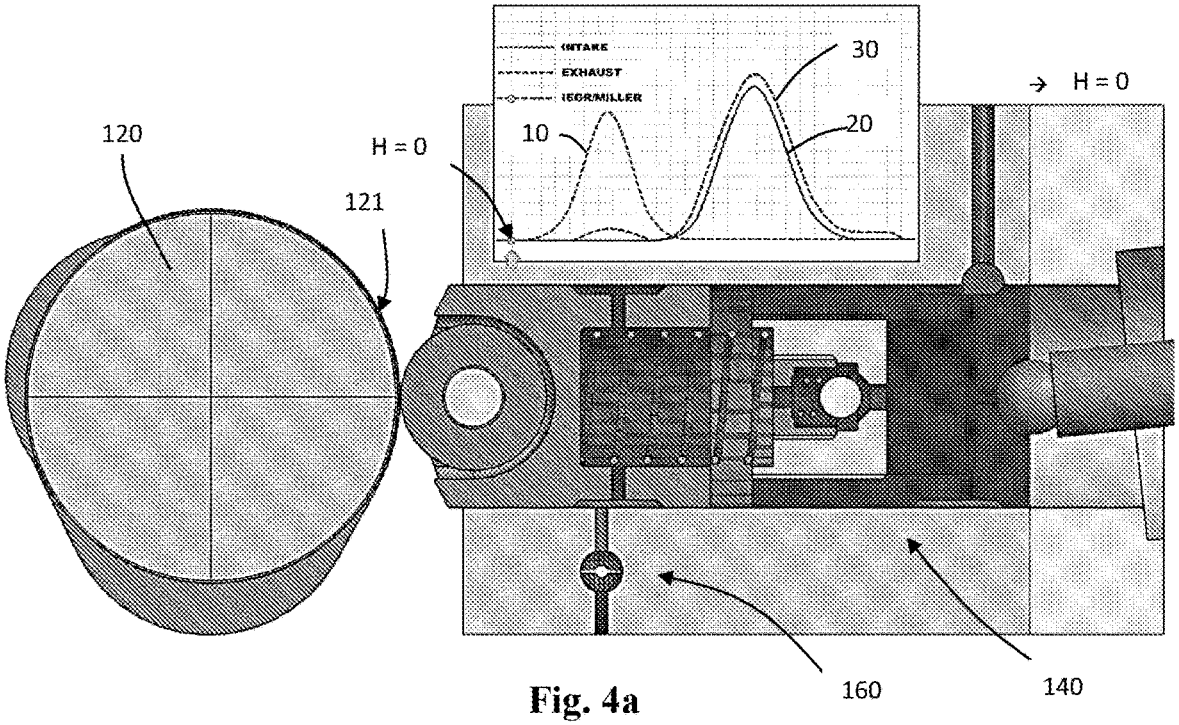
FIGS. 4*a*-4*c* show the timing system of FIG. 1 in the corresponding operating configurations of FIGS. 3*a*-3*c*, but with the control valve closed.
Figure 4B:
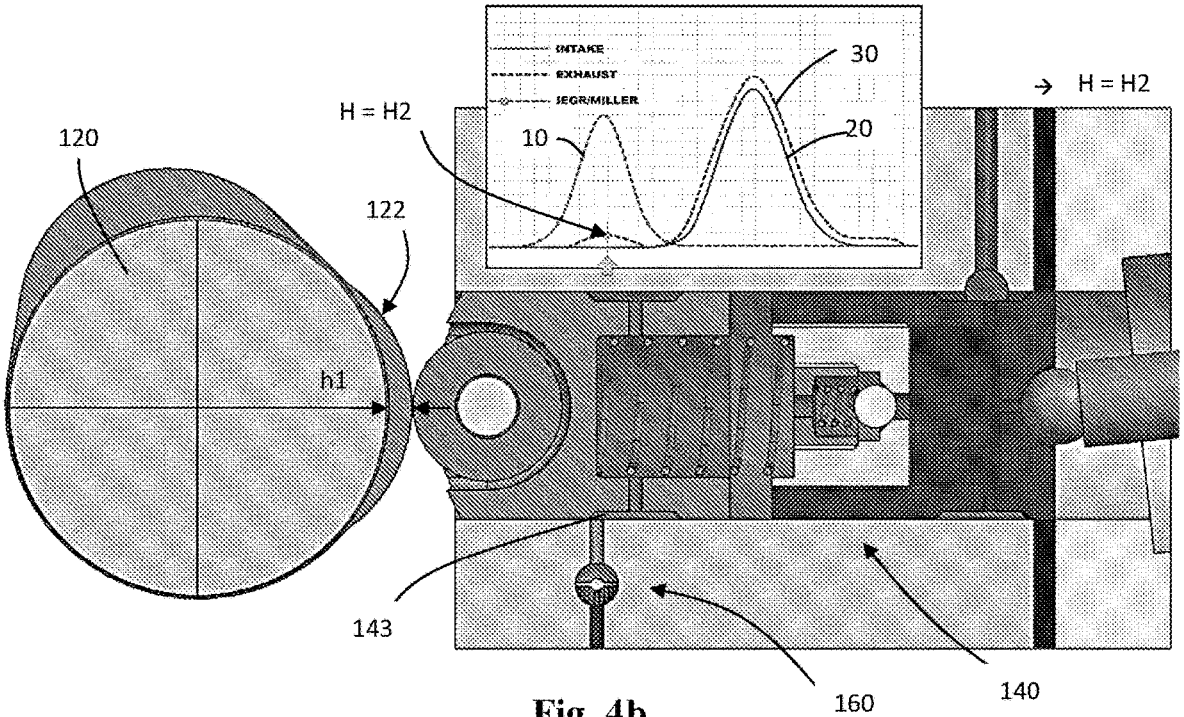
Figure 4C:
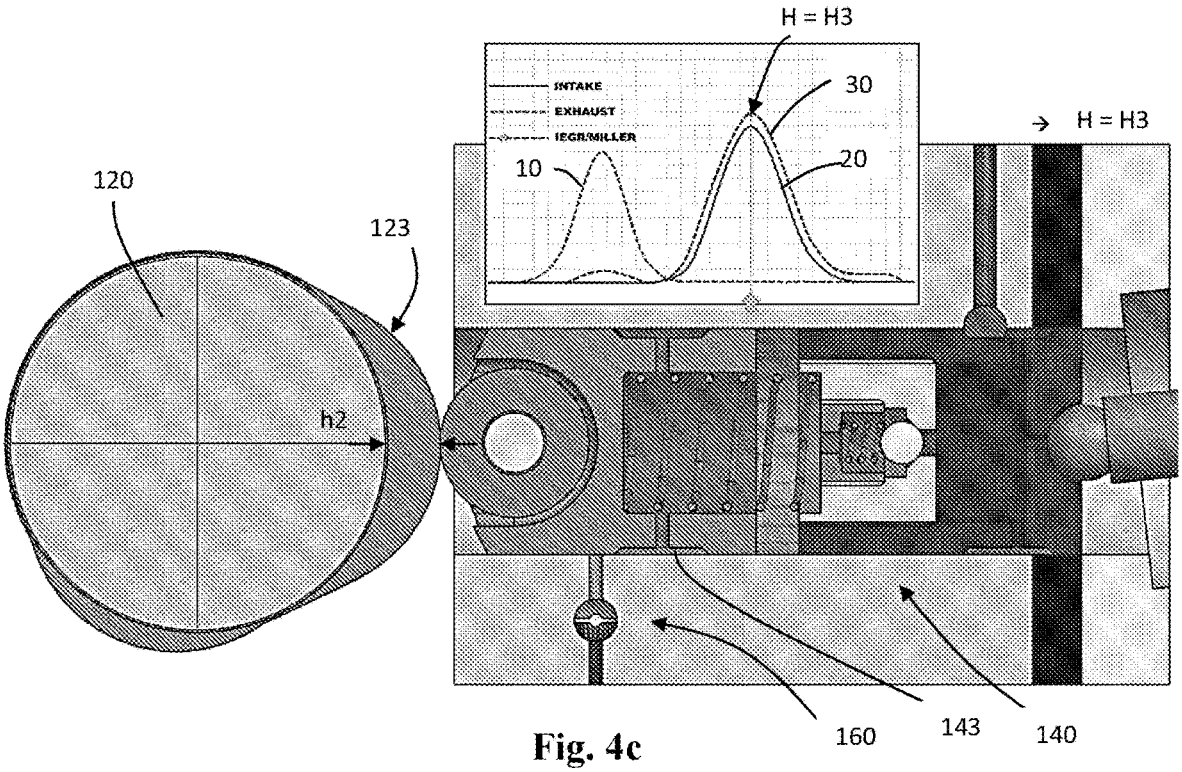

FIGS. 4*a*-4*c* show the same operating configurations as in FIGS. 3*a*-3*c*, but with the control valve 160 closed.

In FIG. 4*a*, the cam 120 cooperates with the remaining components of the timing system by means of its circular base profile 121. The hydraulic tappet 140 does not undergo displacements and consequently the lift H of the intake valve is equal to 0, as in the analogous case with the control valve 160 open, illustrated in FIG. 3*a*.

In FIG. 4*b*, the cam 120 cooperates with the remaining components of the timing system by means of its first cam profile 122. Due to the fact that the control valve 160 is closed and in communication with the drain port 143, the hydraulic tappet 140 is pressurized and, therefore, causes a displacement of the intake valve which will open reaching in the configuration of FIG. 4*b* a lift H equal to a predetermined value H2, greater than 0 but, in any case, less than the first maximum value H1. As already seen, this is the crossing phase between the exhaust valve and the intake valve which allows a non-negligible recirculation of the exhaust gases, i.e., an internal EGR.

Finally, in FIG. 4*c*, the cam 120 cooperates with the remaining components of the timing system by means of its second cam profile 123. The control valve 160 is always closed, but there is no longer communication between it and the drain port 143. Therefore, the hydraulic tappet 140, still under pressure, undergoes and can therefore transfer a further movement to the intake valve which, in the configuration of FIG. 4*c*, will reach a lift H equal to a second maximum value H3 (greater of the first maximum value H1 reached under the same conditions but with the control valve 160 open). This situation, as already mentioned, will ensure that the intake valve, at the end of the intake phase, will still maintain a small but not negligible lift value which influences the subsequent compression phase, reproducing the so-called "Miller" cycle.

The control valve 160 is normally open, therefore it carries out the so-called "failsafe" procedure since in a malfunction situation it will implement the traditional lift curve 20 of the intake valve without penalizing effects on the maximum power performance of the engine.

The overlapping of the openings of the exhaust valve and the inlet valve allows a recirculation of the burnt gases, rich in nitrogen oxides and therefore allows internal EGR to be carried out for each single cylinder, typical of traditional Diesel engines: internal EGR, as is well known, allows the reduction of combustion temperatures to the full benefit of the reduction of harmful emissions and in particular of nitrogen oxides. The present invention allows internal EGR to be carried out without the need for any external circuit.

Furthermore, if the fuel is a hydrogen "carrier", the simultaneous presence of combustion air, ammonia and a suitable quantity of burnt gases allows the production of hydrogen which will have the function of fuel. In practice, an internal "reforming" process is created whose performance is optimized according to the fuel equivalence ratio and the inlet speed of the NH3-H2-air mixtures and the NOx concentration in the recirculated exhaust gases.

Finally, as has been seen, the opening phase of the intake valve, with the control valve 160 closed, continues over time even after the end of the intake phase proper. The delayed closing of the intake valve allows for a so-called "Miller" cycle (from the name of its inventor). In the Miller cycle, as is known, the intake valve has a delayed closure, and remains open for a certain portion of the compression stroke, i.e., it remains open even after having passed bottom dead center (BDC). There are therefore two effects: the return of the intake air into the intake duct and a modest compression until the intake valve closes; after that the actual compression begins. This effect induces a partial filling of the cylinder and consequently lower pressures and maximum combustion temperatures. This allows, especially at partial loads when the closing strategy of the control valve 160 is activated, to reduce harmful emissions.

If we compare the power delivered by a "Miller" cycle, with the same displacement, to that delivered by a conventional engine, the power is lower. In summary, the power of an engine with smaller displacement is obtained, given that the amount of air and fuel sucked in is smaller, but as expansion takes place at full displacement with respect to compression, there is better use of the gas expanded by combustion, with significantly lower specific consumption per unit of power delivered (7-8%). Furthermore, all this takes place with well-expanded gases (less noise), at a lower temperature, with less energy lost in the exhaust and with lower NOx emissions.

Ultimately, the internal combustion engine, according to the present invention, represents a simple but effective retrofit of existing Diesel cycle engines, to reduce the emissions at the engine outlet to levels compatible with the strictest standards (for example, IMO Tier 3) and to operate with alternative fuels (for example ammonia or hydrogen).

In addition, this engine offers the possibility of performing emergency "overloading" of the engine and allows internal EGR to be carried out for each individual cylinder without the need for an external circuit. The internal EGR obviously allows the maximum combustion temperature to be reduced, consequently reducing harmful exhaust emissions.

It is also possible to reform ammonia to hydrogen, without the need for an external reforming apparatus or an external electrolyser. In this way, using hydrogen as fuel it will be possible to work with leaner mixtures.

Finally, the timing system necessary to achieve the aforementioned performances requires only a simple, robust and economical ON/OFF valve.

In addition to the form of the invention as described above, it must be understood that there are numerous other variants. It must also be understood that these forms of embodiment are merely illustrative and do not limit either the scope of the invention, its applications or its possible configurations. On the contrary, although the above description allows the skilled person to implement the present invention at least according to one exemplary form of embodiment thereof, it should be understood that many variations of the described components are possible, without thereby departing from the scope of the invention as defined in the appended claims, which are interpreted literally and/or according to their legal equivalents.

The invention claimed is:

1. An internal combustion engine provided with a timing system (100) comprising:

a camshaft (110) having at least one cam (120) for controlling an intake valve and at least one hydraulic tappet (140), a pressurized oil supply duct (141) and an oil inlet port (142) inside the at least one hydraulic tappet, an oil drain port (143) and an oil exhaust duct (144) in communication with the oil drain port (143), wherein:

the at least one cam (120) has a first cam profile (122) and a second cam profile (123), the the second cam profile having a height (h2) greater than a height (h1) of the first cam profile (122), the oil drain port (143) has a height equal to the height difference between the second cam profile (123) and the first cam profile (122), and a control valve (160) is located in the oil exhaust duct (144) and is in selective fluid communication with the oil drain port (143) to control a lift curve of the intake valve.

2. The internal combustion engine according to claim 1, wherein the internal combustion engine is fed with hydrogen fuel or a liquid fuel that is a hydrogen carrier.

3. The internal combustion engine according to claim 1, wherein when the control valve (160) is in an open configuration (ON) and in communication with the oil drain port (143) and the at least one cam (120) cooperates with the remaining components of the timing system via the first cam profile (122), the at least one hydraulic tappet (140) is not pressurized and a lift (H) of the intake valve is equal to 0.

4. The internal combustion engine according to claim 1, wherein when the control valve (160) is in an open configuration (ON) and is not in communication with the oil drain port (143) and the cam (120) cooperates with the remaining components of the timing system via the second cam profile (123), the at least one hydraulic tappet (140) is pressurized by oil and can therefore transfer motion to the intake valve which reaches a lift (H) equal to a first maximum value (H1).

5. The internal combustion engine according to claim 4, wherein when the control valve (160) is in a closed configuration (OFF) and in communication with the drain port (143) and the cam (120) cooperates with the remaining components of the timing system by means of its first cam profile (122), the at least one hydraulic tappet (140) is put under pressure and the lift (H) of the intake valve is equal to a predetermined value (H2) greater than 0 and less than the first maximum value (H1).

6. The internal combustion engine according to claim 4, wherein when the control valve (160) is in the closed configuration (OFF) and is not in communication with the oil drain port (143) and the cam (120) cooperates with the remaining components of the timing system by means of its second cam profile (123), the at least one hydraulic tappet (140) is pressurized by oil and can therefore transfer motion to the intake valve which reaches the lift (H) equal to a second maximum value (H3), greater than the first maximum value (H1).

7. The internal combustion engine according to claim 1, wherein the control valve (160) is normally open.

8. The internal combustion engine according to claim 1, wherein the control valve (160) is a solenoid valve.

9. The internal combustion engine according to claim 1, wherein the timing system (100) is further provided with at least one roller (130) and at least one pressure rod (150) and is housed in a crankcase of the internal combustion.

10. The internal combustion engine according to claim 1, wherein the timing system (100) is housed in a cylinder head of the internal combustion engine.

* * * * *